US008662932B2

(12) United States Patent
Annis et al.

(10) Patent No.: US 8,662,932 B2
(45) Date of Patent: Mar. 4, 2014

(54) CONNECTOR SYSTEM USING RIGHT ANGLE, BOARD-MOUNTED CONNECTORS

(75) Inventors: Kyle Gary Annis, Hummelstown, PA (US); Wayne Samuel Davis, Harrisburg, PA (US); Robert Neil Whiteman, Jr., Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/370,399

(22) Filed: Feb. 10, 2012

(65) Prior Publication Data

US 2013/0210282 A1 Aug. 15, 2013

(51) Int. Cl.
*H01R 33/00* (2006.01)

(52) U.S. Cl.
USPC ..... 439/638

(58) Field of Classification Search
USPC ..... 439/638, 108, 55, 607.1, 607.07, 439/607.11
See application file for complete search history.

(56) References Cited

U.S. PATENT DOCUMENTS 4,703,394 A * 10/1987 Petit et al. ..... 361/790
5,360,349 A * 11/1994 Provencher et al. ..... 439/108
5,588,844 A * 12/1996 Sipe ..... 439/65
5,718,606 A * 2/1998 Rigby et al. ..... 439/607.1
6,299,484 B2 * 10/2001 Van Woensel ..... 439/607.07
6,527,588 B2 * 3/2003 Paagman ..... 439/607.11
6,540,522 B2 * 4/2003 Sipe ..... 439/61
6,607,401 B1 * 8/2003 Weaver et al. ..... 439/607.09
7,083,432 B2 * 8/2006 Hull et al. ..... 439/79
7,988,456 B2 * 8/2011 Davis et al. ..... 439/65
8,002,581 B1 * 8/2011 Whiteman et al. ..... 439/607.18
8,079,847 B2 * 12/2011 Davis et al. ..... 439/65
8,267,724 B2 * 9/2012 Dodds et al. ..... 439/660
8,366,485 B2 * 2/2013 Johnescu et al. ..... 439/607.07
8,371,876 B2 * 2/2013 Davis ..... 439/607.07
2003/0220019 A1 * 11/2003 Billman et al. ..... 439/608
2004/0092140 A1 * 5/2004 Mashiyama et al. ..... 439/83
2007/0021002 A1 * 1/2007 Laurx et al. ..... 439/608
2008/0246555 A1 * 10/2008 Kirk et al. ..... 333/125
2009/0149041 A1 * 6/2009 Morlion et al. ..... 439/65

* cited by examiner

*Primary Examiner* — Alexander Gilman

(57) ABSTRACT

A connector system having right angle, board-mounted header and receptacle connectors includes both a power interface and a signal interface for transmitting power and data signals there between. Optionally, the connectors may have features that allow the corresponding circuit boards to be offset. The connectors may have features that provide guidance for alignment of the header and receptacle connectors. The connectors may have features to enhance the electrical performance of the conductors defining the signal paths through the connector system. The connectors may have features that orient the components of the header and receptacle connectors for mounting to the circuit boards to maintain the true positions of the contacts for mounting to the circuit board.

15 Claims, 7 Drawing Sheets

CONNECTOR SYSTEM USING RIGHT ANGLE, BOARD-MOUNTED CONNECTORS

BACKGROUND OF THE INVENTION

The subject matter herein relates generally to connector systems using right angle, board-mounted connectors.

Some connector systems utilize electrical connectors to interconnect two circuit boards, such as a motherboard and daughtercard. Signal loss and/or signal degradation is a problem in known connector systems. For example, cross talk results from an electromagnetic coupling of the fields surrounding an active conductor or differential pair of conductors and an adjacent conductor or differential pair of conductors. The strength of the coupling generally depends on the separation between the conductors, thus, cross talk may be significant when the electrical conductors are disposed in close proximity to each other.

Moreover, as speed and performance demands increase, known electrical connectors are proving to be insufficient. Additionally, there is a desire to increase the density of electrical connectors to increase throughput of the electrical system, without an appreciable increase in size of the electrical connectors, and in some cases, a decrease in size of the electrical connectors. Such increase in density and/or reduction in size causes further strains on performance.

A need remains for a connector system that provides compensation and shielding to meet particular performance demands.

BRIEF DESCRIPTION OF THE INVENTION

In one embodiment, a connector system is provided including a right angle header connector and a right angle receptacle connector. The header connector has a header housing and a plurality of header contact modules coupled to the header housing. The header housing has a cavity open at a front of the header housing. The header contact modules include a plurality of header contacts extending between mating portions and mounting portions. The header contacts are right angle contacts having the mating portions oriented generally perpendicular with respect to the mounting portions. The mating portions are positioned in the cavity and define separable mating interfaces. The mounting portions extend from bottoms of the header contact modules for mounting to a circuit board. The receptacle connector has a receptacle housing and a plurality of receptacle contact modules coupled to the receptacle housing. The receptacle housing is received in the cavity of the header housing through the front of the header housing. The receptacle contact modules have a plurality of receptacle contacts extending between mating portions and mounting portions. The receptacle contacts are right angle contacts having the mating portions oriented generally perpendicular with respect to the mounting portions. The mating portions of the receptacle contacts are mated to the mating portions of the header contacts. The mounting portions of the receptacle contacts extend from bottoms of the receptacle contact modules for mounting to a circuit board. The bottoms of the receptacle contact modules are offset with respect to the bottoms of the header contact modules.

In another embodiment, a connector system is provided including a right angle header connector and a right angle receptacle connector. The header connector includes a header housing having a header power wing and a header signal wing. The header power wing holds a header power contact and has a guide feature. The header signal wing has a cavity open at a front of the header housing. The header signal wing holds a plurality of header contact modules each having a plurality of header contacts extending between mating portions and mounting portions. The header contacts are right angle contacts having the mating portions oriented generally perpendicular with respect to the mounting portions. The mating portions are positioned in the cavity and define separable mating interfaces. The receptacle connector is coupled to the header connector and has a receptacle housing having a receptacle power wing and a receptacle signal wing. The receptacle power wing holds a receptacle power contact that engages the header power contact. The receptacle power wing has a guide feature engaging the guide feature of the header power wing to guide mating of the header connector with the receptacle connector. The receptacle signal wing is received in the cavity through the front of the header housing and holds a plurality of receptacle contact modules each having a plurality of receptacle contacts extending between mating portions and mounting portions. The receptacle contacts are right angle contacts having the mating portions oriented generally perpendicular with respect to the mounting portions. The mating portions of the receptacle contacts are mated to the mating portions of the header contacts. The receptacle power wing extends forward of the receptacle signal wing such that the guide features align the receptacle connector with the header connector prior to the receptacle signal wing being received in the cavity.

In a further embodiment, a connector system is provided that includes a right angle header connector having a header housing with a cavity open at a front of the header housing and walls defining a top, bottom and sides. The top extends to a rear that has mounting lugs extending therefrom. The header housing has a plurality of channels with header contact modules loaded into corresponding channels through the rear. The header contact modules each have a dielectric frame holding a plurality of header contacts. The header contacts have mating portions extending from a front edge of the dielectric frame and mounting portions extending from a bottom edge of the dielectric frame. The header contacts are right angle contacts having the mating portions oriented generally perpendicular with respect to the mounting portions. The mating portions are positioned in the cavity and define separable mating interfaces. The mounting portions are configured to be mounted to a circuit board. The dielectric frame includes module lugs extending from a rear of the dielectric frame. An organizer is coupled to the mounting lugs and the module lugs to hold a position of the header contact modules with respect to the header housing.

DETAILED DESCRIPTION OF THE INVENTION

Embodiments described herein include a connector system having right angle, board-mounted connectors. The connectors include both a header connector and a receptacle connector. The connectors have both a power interface and a signal interface for transmitting power and data signals therebetween. When the header and receptacle connectors are mated together, the header and receptacle connectors are generally coplanar. It should be noted that although the embodiments described herein are described with respect to right angle connectors, the embodiments may be used with any suitable connectors.

Embodiments described herein have features that allow the circuit boards to be offset. For example, the connector system allows a mother board and a daughter card, mounted to the header connector and receptacle connector, to be offset with respect to one another.

Embodiments described herein have features on the header connector and receptacle connector that provide x and y guidance for alignment of the header and receptacle connectors prior to mating to avoid damaging or stubbing of contacts in the connectors during mating.

Embodiments described herein provide different segments of the receptacle and header connectors for making the power connections and the signal connections to enhance the electrical performance of the connector system. The receptacle and header connectors are designed to allow the power connection and the signal connection to be made together as opposed to providing different connectors or modules for making the power and signal connections.

Embodiments described herein provide for high speed data signals to be conveyed between the receptacle and header connectors. The receptacle and header connectors have features to enhance the electrical performance of the conductors defining the signal paths through the connector system.

Embodiments described herein provide features that orient the components of the header and receptacle connectors for mounting to the circuit boards. True positions of the contacts of the header and receptacle connectors are controlled for terminating the large number of contacts to the circuit board simultaneously.

Figure 1:
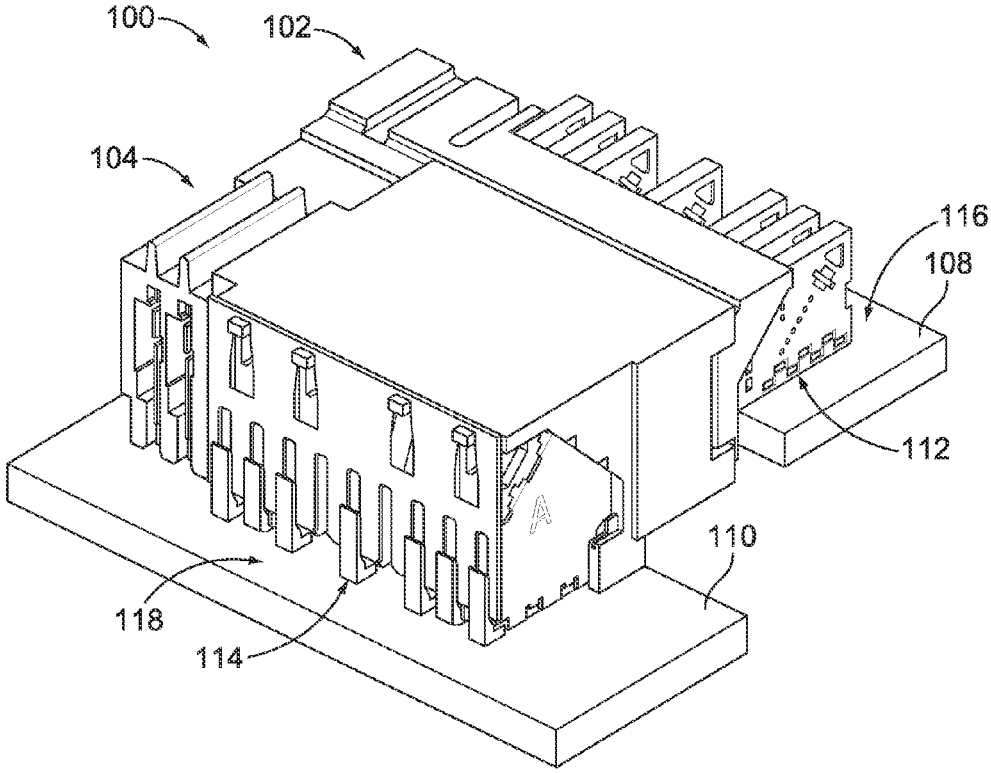
FIG. 1 illustrates a connector system formed in accordance with an exemplary embodiment, showing a right angle receptacle connector coupled to a right angle header connector.
Figure 2:
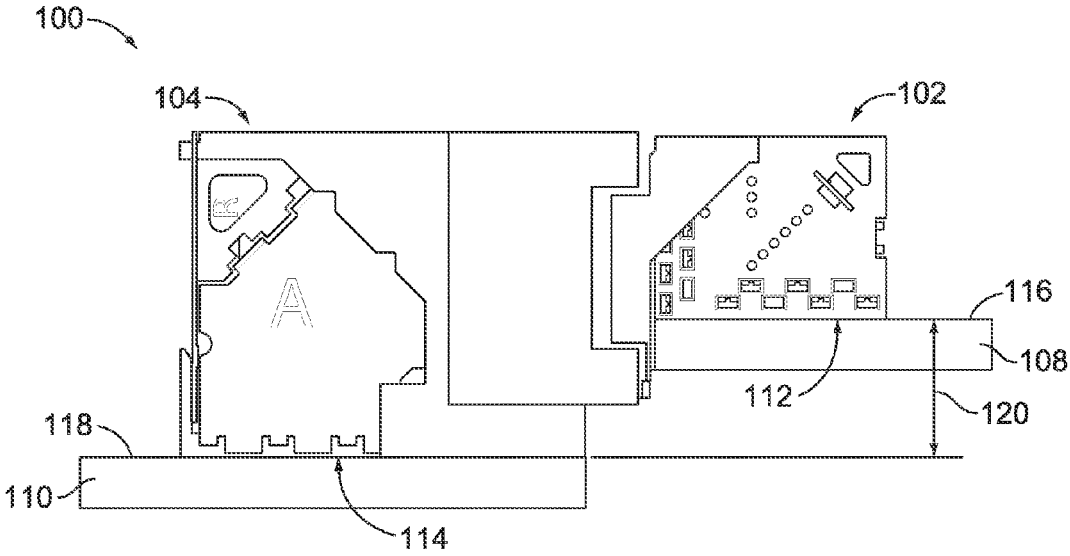
FIG. 2 is a side view of the connector system.
Figure 3:
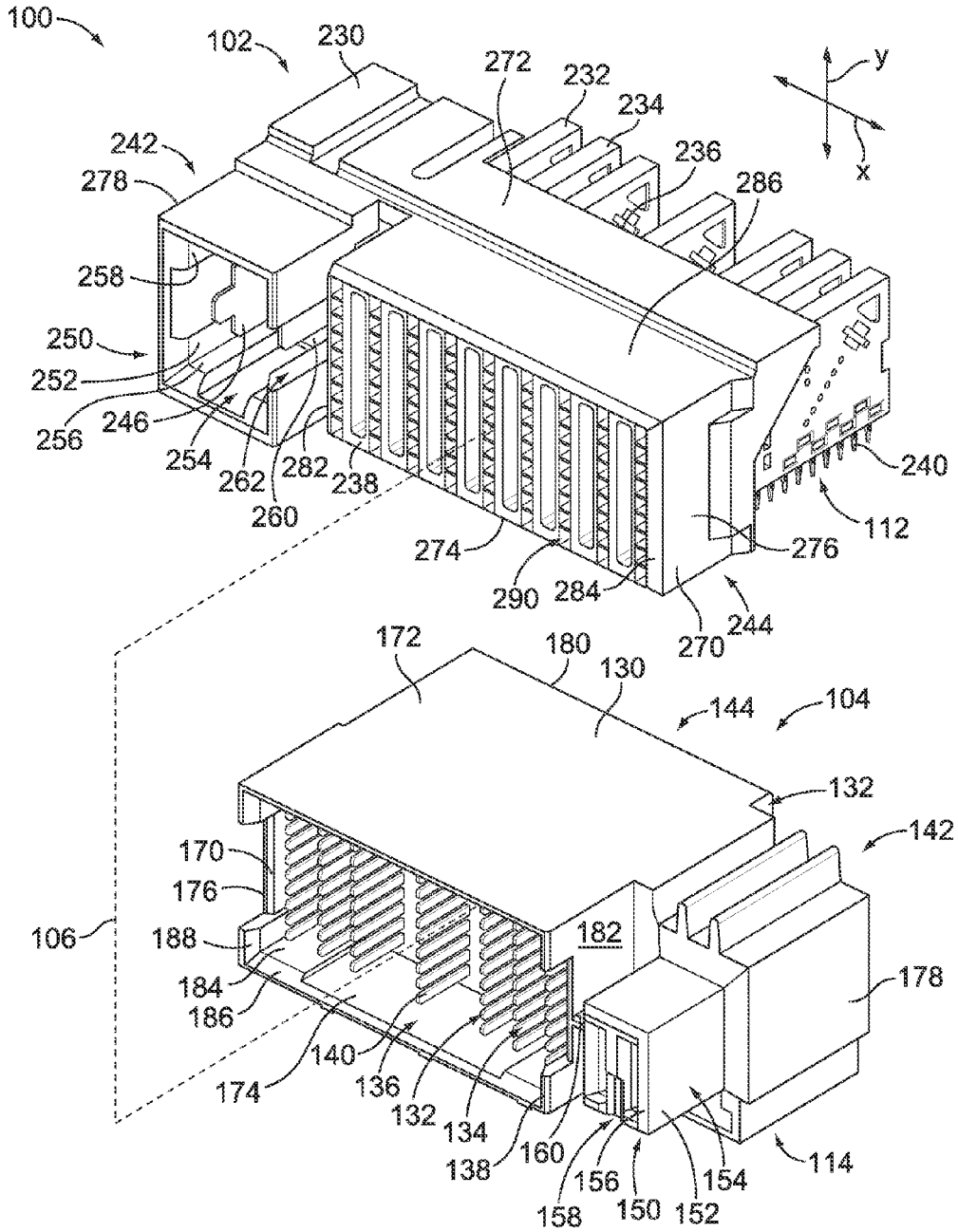
FIG. 3 illustrates the right angle receptacle connector unmated from the right angle header connector and poised for mating along a mating axis.

FIG. 1 illustrates a connector system 100 formed in accordance with an exemplary embodiment, showing a right angle receptacle connector 102 coupled to a right angle header connector 104. FIG. 2 is a side view of the connector system 100 showing the right angle receptacle connector 102 mated with right angle header connector 104. FIG. 3 illustrates the right angle receptacle connector 102 unmated from the right angle header connector 104 and poised for mating along a mating axis 106.

When the header and receptacle connectors 102, 104 are mated, as shown in FIGS. 1 and 2, the header and receptacle connectors 102, 104 interconnect a first circuit board 108 and a second circuit board 110. The receptacle connector 102 is mounted to the first circuit board 108. The header connector 104 is mounted to the second circuit board 110. Optionally, the circuit boards 108, 110 may be mother boards or daughter cards. The circuit boards 108, 110 may be line cards or switch cards. In an exemplary embodiment, the receptacle and header connectors 102, 104 are mounted at edges of the first and second circuit boards 108, 110.

The receptacle and header connectors 102, 104 have board interfaces 112, 114, respectively, at bottoms of the receptacle and header connectors 102, 104. The board interfaces 112, 114 extend along mounting surfaces 116, 118 of the first and second circuit boards 108, 110, respectively. In an exemplary embodiment, as shown in FIG. 2, when the receptacle and header connectors 102, 104 are mated together, the header and receptacle connectors 102, 104 are generally aligned with one another, with the board interfaces 112, 114 and the mounting surfaces 116, 118 being offset by a distance 120. When the receptacle connector 102 and the header connector 104 are mated together, a portion of the receptacle connector 102 is received within the header connector 104 and is aligned with the header connector 104 along the mating axis 106. The first circuit board 108 is positioned above the bottoms of the housings of the receptacle and header connectors 102, 104. The second circuit board 110 is positioned below the bottoms of the housings of the receptacle and header connectors 102, 104. The circuit boards 108, 110 and parallel and non-coplanar to one another being oriented along different parallel planes defined by the board interface 112 (or mounting surface 116) and the board interface 114 (or mounting surface 118) that define a board offset. The offset distance 120 may be controlled by changing the size or shape of the receptacle connector 102 or the header connector 104.

Figure 4:
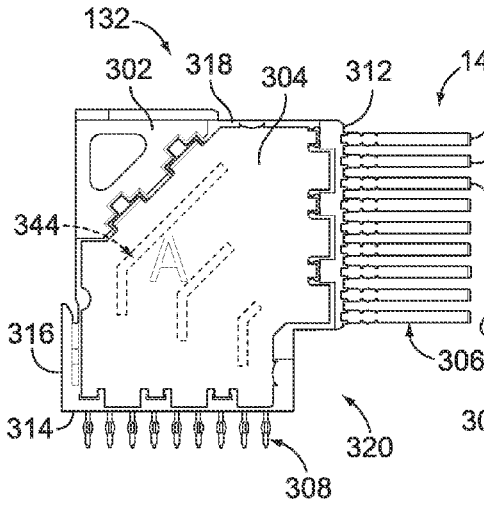
FIG. 4 is a side view of a contact module for the header connector.
Figure 6:
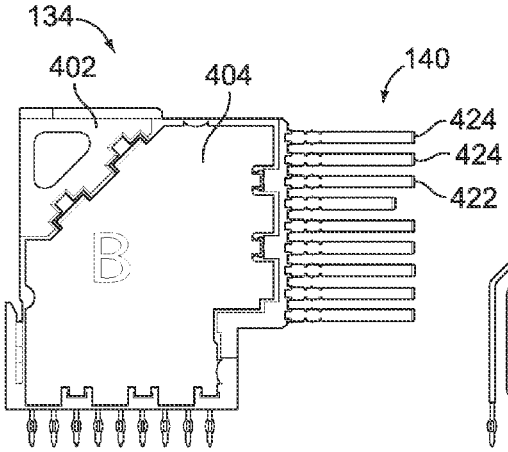
FIG. 6 is a side view of a contact module for the header connector.

With reference to FIG. 3, the header connector 104 includes a header housing 130 and a plurality of header contact modules 132, 134 (shown in FIGS. 4 and 6, respectively). The header housing 130 has a cavity 136 open at a front 138 of the header housing 130. The header contact modules 132, 134 hold a plurality of header contacts, generally identified at 140. An exterior perimeter of the header housing 130 defines a housing window. With reference back to FIG. 2, the bottoms of the header contact modules 132, 134 are outside (e.g. below or vertically offset with respect to) the housing window.

In an exemplary embodiment, the header housing 130 has a header power wing 142 and a header signal wing 144 at opposite ends of the header housing 130. The header signal wing 144 holds the header contact modules 132, 134. The header signal wing 144 holds the header contacts 140 and defines a mating interface for transmitting data signals between the header connector 104 and the receptacle connector 102. The header power wing 142 holds header power contacts 146 (shown in FIG. 9). The header power contacts 146 define a power interface for conveying power between the header connector 104 and the receptacle connector 102.

The header power wing 142 and the header signal wing 144 are different segments or sections of the header housing 130. The header power wing 142 and the header signal wing 144 are integrally formed as part of the header housing 130. For example, the header housing 130 may be manufactured by injection molding a plastic material into a mold having a predetermined shape. The mold may form the header power wing 142 and the header signal wing 144 during a common molding process such that the header power wing 142 and the header signal wing 144 are part of the same structure defining the header housing 130. Having the header power contacts 146 and the header contacts 140 held by a common header housing 130 allows both the header power contacts 146 and the header contacts 140 to be mated during a common mating process to the receptacle connector 102. Having the header power contacts 146 and the header contacts 140 part of a common header housing 130 allows the header power contacts 146 and the header contacts 140 to be mounted to the second circuit board 110 (shown in FIGS. 1 and 2) at the same time during a common assembly step.

The header power wing 142 and the header signal wing 144 may have any size and shape depending on the particular application. In an exemplary embodiment the header power wing 142 and the header signal wing 144 are sized and shaped differently. The size and shape of the header power wing 142 and the header signal wing 144 may depend on the number of header contacts 140 and header power contacts 146 required for the particular application.

In an exemplary embodiment, the header power wing 142 includes guide features 150 that are used to guide alignment and mating with the receptacle connector 102. In the illustrated embodiment, the guide features 150 are defined by an exterior surface 152 of a projection 154 of the header power wing 142. The guide features 150 may include chamfered surfaces 156 at a front of the projection 154. The guide features 150 may include a slot 158 in the projection 154, such as at the bottom of the projection 154. Other types of guide features 150 may be used in alternative embodiments. Optionally, the guide features 150 may provide alignment between the header connector 104 and the receptacle connector 102 in either a horizontal direction (e.g. an X direction) or in a vertical direction (e.g. a Y direction). Optionally, the guide features 150 may provide alignment in both a horizontal and a vertical direction.

A rib 160 extends between the projection 154 and the header signal wing 144. The rib 160 may be approximately centrally located between a top and a bottom of the projection 154. The rib 160 may be recessed rearward of the front of the projection 154. The rib 160 adds support for the projection 154.

The header housing 130 has a plurality of walls 170 defining an exterior of the header housing 130 and interior surfaces of portions of the header housing 130, such as the cavity 136. In an exemplary embodiment, the header housing 130 includes walls 170 that define a top 172, a bottom 174 and sides 176, 178 of the header housing 130. The header housing 130 has a rear 180 opposite the front 138. In an exemplary embodiment, the walls 170 define a side 182 of the header signal wing 144. Optionally, the header signal wing 144 may be generally rectangular in shape defined by the top 172, the bottom 174, the sides 176, 182, and the front 138 and rear 180. Other shapes are possible in alternative embodiments. The walls 170 may define a generally rectangular cavity 136 that receives the receptacle connector 102.

In an exemplary embodiment, the header signal wing 144 has guide features 184 in the cavity 136 for aligning the receptacle connector 102 with the cavity 136 during mating. Optionally, the guide features 184 may include ramps 186 along the top and bottom of the cavity 136 that control the vertical alignment of the receptacle connector 102 with the cavity 136. The guide features 184 may include ramps 188 along the sides of the cavity 136 that provide horizontal alignment of the receptacle connector 102 with the cavity 136. Other types of guide features 184 may be provided in alternative embodiments.

The receptacle connector 102 includes a receptacle housing 230 and a plurality of receptacle contact modules 232, 234. The receptacle contact modules 232, 234 are loaded into the receptacle housing 230 through a rear 236 of the receptacle housing 230 and are accessible through a front 238 of the receptacle housing 230. The receptacle contact modules 232, 234 hold a plurality of receptacle contacts, generally identified at 240 and shown in FIGS. 10 and 11. With reference back to FIG. 2, the bottoms of the receptacle contact modules 232, 234 are inside (e.g. vertically aligned with) the housing window defined by the header housing 130.

In an exemplary embodiment, the receptacle housing 230 has a receptacle power wing 242 and a receptacle signal wing 244 at opposite ends of the receptacle housing 230. The receptacle signal wing 244 holds the receptacle contact modules 232, 234. The receptacle signal wing 244 holds the receptacle contacts 240 and defines a mating interface for transmitting data signals between the receptacle connector 102 and the header connector 104. The receptacle power wing 242 holds receptacle power contacts 246. The receptacle power contacts 246 define a power interface for conveying power between the receptacle connector 102 and the header connector 104.

The receptacle power wing 242 and the receptacle signal wing 244 are different segments or sections of the receptacle housing 230. The receptacle power wing 242 and the receptacle signal wing 244 are integrally formed as part of the receptacle housing 230. For example, the receptacle housing 230 may be manufactured by injection molding a plastic material into a mold having a predetermined shape. The mold may form the receptacle power wing 242 and the receptacle signal wing 244 during a common molding process such that the receptacle power wing 242 and the receptacle signal wing 244 are part of the same structure defining the receptacle housing 230. Having the receptacle power contacts 246 and the receptacle contacts 240 held by a common receptacle housing 230 allows both the receptacle power contacts 246 and the receptacle contacts 240 to be mated during a common mating process to the header connector 104. Having the receptacle power contacts 246 and the receptacle contacts 240 held by a common receptacle housing 230 allows the receptacle power contacts 246 and the receptacle contacts 240 to be mounted to the first circuit board 108 (shown in FIGS. 1 and 2) at the same time during a common assembly step.

The receptacle power wing 242 and the receptacle signal wing 244 may have any size and shape depending on the particular application. In an exemplary embodiment, the receptacle power wing 242 and the receptacle signal wing 244 are sized and shaped differently. The size and shape of the receptacle power wing 242 and the receptacle signal wing 244 may depend on the number of receptacle contacts 240 and receptacle power contacts 246 required for the particular application.

In an exemplary embodiment, the receptacle power wing 242 includes guide features 250 that are used to guide alignment and mating with the receptacle connector 102. In the illustrated embodiment, the guide features 250 are defined by an interior surface 252 of a power cavity 254 of the receptacle power wing 242. The power cavity 254 receives the projection 154 of the header power wing 142. The guide features 250 may include ramps 256 along the top and bottom of the power cavity 254 that control the vertical alignment of the projection 154 within the power cavity 254. The guide features 250 may include ramps 258 along the sides of the power cavity 254 that provide horizontal alignment of the projection 154 within the power cavity 254. The ramps 256, 258 may be chamfered or include lead-ins to guide the relative position of the header housing 130 with respect to the receptacle housing 230. The guide features 250 may include a slot 262 open through a side wall of the receptacle power wing 242 that receives the rib 160. Other types of guide features 250 may be used in alternative embodiments. Optionally, the guide features 250 may provide alignment between the receptacle connector 102 and the header connector 104 in either a horizontal direction or in a vertical direction. Optionally, the guide features 250 may provide alignment in both a horizontal direction and a vertical direction.

The receptacle housing 230 has a plurality of walls 270 defining an exterior of the receptacle housing 230 and interior surfaces of portions of the receptacle housing 230, such as the power cavity 254. In an exemplary embodiment, the receptacle housing 230 includes walls 270 that define a top 272, a bottom 274 and sides 276, 278 of the receptacle housing 230. In an exemplary embodiment, the walls 270 define a side 282 of the receptacle signal wing 244. Optionally, the receptacle signal wing 244 may be generally rectangular in shape defined by the top 272, the bottom 274, the sides 276, 282, the front 238 and the rear 236. Other shapes are possible in alternative embodiments. The walls 270 may define a generally rectangular power cavity 254 that receives the projection 154.

The receptacle housing 230 includes contact channels 290 extending therethrough between the front 238 and the rear 236. The contact channels 290 receive the receptacle contacts 240 when the receptacle contact modules 232, 234 are loaded into the receptacle housing 230. The contact channels 290 receive the header contacts 140 when the receptacle connector 102 is mated with the header connector 104. For example, when the receptacle signal wing 244 is loaded into the cavity 136, the header contacts 140 are loaded into the contact channels 290. The receptacle contacts 240 engage the header contacts 140 within the contact channels 290. The receptacle housing 230 and the header housing 130 are aligned (e.g. horizontally and vertically) prior to the header contacts 130 being loaded into the contact channels 290 to prevent stubbing or damage to the header contacts 140 and/or the receptacle contacts 240.

In an exemplary embodiment, the receptacle signal wing 244 has guide features 284 for aligning the receptacle connector 102 with the cavity 136 during mating. Optionally, the guide features 284 may include an exterior surface 286 of the walls 270 that engage the ramps 186 and/or 188 of the cavity 136 that control the vertical alignment and/or the horizontal alignment of the receptacle connector 102 with the cavity 136. Other types of guide features 284 may be provided in alternative embodiments.

In an exemplary embodiment, the receptacle power wing 242 extends forward of the receptacle signal wing 244. The front 238 at the receptacle power wing 242 is positioned forward of the front 238 at the receptacle signal wing 244. The header power projection 154 is received in the receptacle power cavity 254 prior to the receptacle signal wing 244 being received in the header cavity 136. The guide features 150, 250 of the power side interface prior to the guide features 184, 284 of the signal side interfacing. The guide features 150, 250 are used to align the header and receptacle housings 130, 230 prior to the guide features 184, 284 aligning the header and receptacle housings 130, 230. The guide features 150, 250 may be used for coarse alignment and the guide features 184, 284 may be used for fine alignment. The guide features 184, 284 may have a tighter tolerance than the guide features 150, 250. Optionally, some of the guide features 150, 250 may be used for pre-alignment (e.g. coarse alignment), while other guide features 150, 250 may be used for additional alignment (e.g. fine alignment).

The header and/or receptacle housings 130, 230 may include cores or openings therein that receive fasteners for securing the housings 130, 230 to the circuit boards 108, 110. For example, the cores may be formed during molding of the housings 130, 230. The fasteners may resist shock and vibration.

Figure 5:
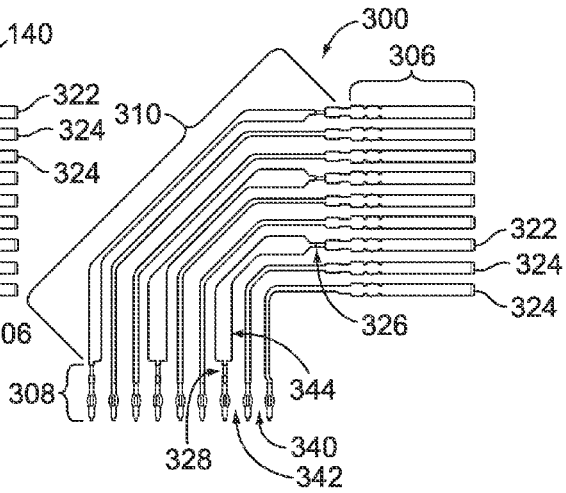
FIG. 5 illustrates a lead frame for the contact module shown in FIG. 4.
Figure 7:
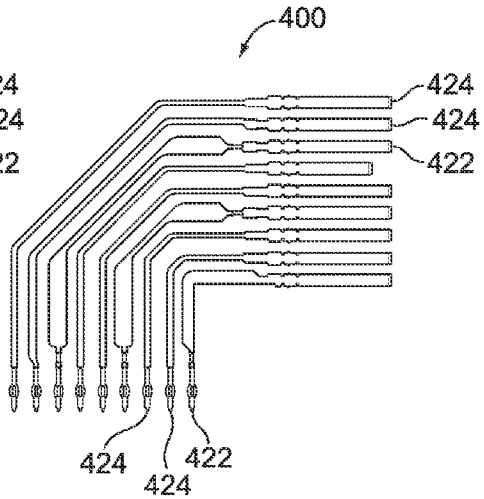
FIG. 7 illustrates a lead frame for the contact module shown in FIG. 6.

FIG. 4 is a side view of a contact module 132 for the header connector 104 (shown in FIGS. 1 through 3). FIG. 5 illustrates a lead frame 300 for the contact module 132 (shown in FIG. 4). FIG. 6 is a side view of a contact module 134 for the header connector 104 (shown in FIGS. 1-3). FIG. 7 illustrates a lead frame 400 for the contact module 134. The contact modules 132, 134 may be substantially similar to one another, however the contact modules 132, 134 may have a different arrangement of signal and ground contacts. The lead frames 300, 400 may be substantially similar to one another, however the lead frames 300, 400 may have a different arrangement of signal and ground contacts.

With reference to FIGS. 4 and 5, the contact module 132 includes a dielectric frame 302 holding the lead frame 300. The lead frame 300 comprises the header contacts 140. A ground shield 304 is coupled to one side of the dielectric frame 302. The ground shield 304 provides electrical shielding for the header contacts 140 of the lead frame 300. The ground shield 304 may be selectively electrically coupled to at least some of the header contacts 140.

The header contacts 140 have mating portions 306 extending from the dielectric frame 302 and mounting portions 308 extending from the dielectric frame 302. The header contacts 140 have encased portions 310 extending between the mating portions 306 and the mounting portions 308. The encased portions 310 are the portions of the header contacts 140 that are surrounded by the dielectric frame 302. In an exemplary embodiment, the header contacts 140 are right angle contacts. The right angle contacts have the mating portions 306 and the mounting portions 308 orientated generally perpendicular with respect to one another. The encased portions 310 transition between the mating portions 306 and the mounting portions 308. The mating portions 306 extend forward from a mating edge 312 of the dielectric frame 302. The mounting portions 308 extend from a mounting edge 314 of the dielectric frame 302. In the illustrated embodiment, the mating edge 312 defines a front edge of the dielectric frame 302 while the mounting edge 314 defines a bottom edge of the dielectric frame 302. The mounting edges 314 may define a bottom of the contact module, and may be referred to hereinafter as a bottom 314. The mating edge 312 and the mounting edge 314 are orientated generally perpendicular with respect to one another.

The dielectric frame 302 includes a rear edge 316 opposite the mating edge 312 and a top edge 318 opposite the mounting edge 314. In an exemplary embodiment, the dielectric frame 302 generally defines a rectangular structure bounded by the edges 312 through 318. The edges 312 through 318 may include bump outs, notch outs, protrusions, tabs, lugs, projections or other features that create non planar edges, however the overall structure may be generally rectangular. Other shapes are possible in alternative embodiments. The mating edge 312 and the mounting edge 314 generally meet at an intersection area 320, such as a corner, and extend radially out therefrom. The header contacts 140 are stacked outward from the intersection area 320 such that the header contacts 140 are positioned successively radially outward from other header contacts 140.

The dielectric frame 302 encases the header contacts 140. In an exemplary embodiment, the dielectric frame 302 is manufactured using an over-molding process. During the over-molding process, the lead frame 300 is encased in a dielectric material, which forms the dielectric frame 302. Prior to over-molding, the lead frame 300 may be stabilized by a carrier strip (not shown) which is removed and discarded after the over-molding process that creates the dielectric frame 302. The dielectric frame 302 may be manufactured by other processes in alternative embodiments.

The lead frame 300 includes a plurality of the header contacts 140 that extend along predetermined paths to electrically connect the second circuit board 110 (shown in FIGS. 1 and 2) and the receptacle connector 102 (shown in FIGS. 1 through 3). The header contacts 140 include the mating and mounting portions 306, 308 as well as the encased portions 310. Optionally, the encased portions 310 may extend obliquely for at least part of the path between the mating and mounting portions 306, 308. For example, the encased portions 310 may extend at approximately a 45 degree angle for at least part of the path between the mating portions 306 and the mounting portions 308.

The header contacts 140 may be either signal contacts or ground contacts in an exemplary embodiment. In other embodiments, the header contacts 140 may be other types of contacts, such as power contacts, sense contacts or other types of contacts. The lead frame 300 may include any number of header contacts 140, any number of which may be selected as signal contacts, ground contacts, power contacts or sense contacts according to a desired pinout selected for the contact module 132. In an exemplary embodiment, adjacent signal contacts may function as differential pairs, and each differential pair may be separated by a ground contact. In the illustrated embodiment, the header contacts 140 are arranged according to a ground-signal-signal pattern (G-S-S), from top to bottom, where the grounds are identified as header ground contacts 322 and the signals are identified as header signal contacts 324.

In an exemplary embodiment, the header ground contacts 322 include necked-down portions 326, 328 proximate to the mating portions 306 and the mounting portions 308, respectively. The necked-down portions 326, 328 are configured to be engaged by the ground shield 304 when the ground shield 304 is coupled to the dielectric frame 302. The necked-down portions 326, 328 are narrower than adjacent segments of the header ground contacts 322. The ground shield 304 includes ground tabs 330, 332 that extend into the dielectric frame 302 to engage the necked-down portions 326, 328, respectively. The ground tabs 330, 332 may be bent approximately 90° with respect to the ground shield 304 to pass through openings in the dielectric frame 302 to engage the header ground contacts 322. The ground tabs 330, 332 may have a slot with opposed beams, where the slot receives the necked-down portion 326 or 328 such that the opposed beams engage the necked-down portion 326 or 328 on opposite sides thereof. The ground tabs 330, 332 may engage, and be electrically connected to, the necked-down portions 326, 328 by other means or features in alternative embodiments.

In an exemplary embodiment, the header ground contacts 322 have compensation portions 334 along segments thereof to control an electrical characteristic of the signals conveyed through the contact module 132. In the illustrated embodiment, the compensation portions 334 are wider than adjacent segments of the header ground contacts 322. The additional width of the header ground contacts 322 along the compensation portions 334 positions the header ground contacts 322 closer to the header signal contacts 324 along the compensation portions 334. Having the header ground contacts 322 closer to the header signal contacts 324 affects the impedance of the signals transmitted by the header signal contacts 324. The size, shape and length of the compensation portions 334 may be controlled to achieve a target impedance, such as 85 ohms.

Gaps 340 are defined between each of the header signal contacts 324 and gaps 342 are defined between each of the header signal contacts 324 and the adjacent header ground contacts 322. The width of the gaps 340 or 342 may vary along the length of the header contacts 140. The gaps 342 may be narrower than the gaps 340, or alternatively, the gaps 340 may be narrower than the gaps 342. The gaps 340 between radially inner pairs of header signal contacts 324 may be different than the gaps 340 of the radially outer pairs of header signal contacts 324. The width of the gaps 340, 342 may be selected to control a noise persistence of the header contact module 132.

Each of the header signal contacts 324 has a predetermined length defined between the mating portions 306 and the mounting portions 308. The lengths of each of the header signal contacts 324 may be different, due at least in part to the right angle nature of the header contact module 132. For example, the radially inner header signal contacts 324 are generally shorter than the radially outer header signal contacts 324. While the header signal contacts 324 within a differential pair have approximately equal lengths, because of factors such as the size constraint of the header contact module 132 and the cost or complexity of manufacturing, the radially inner header signal contact 324 within each differential pair is generally slightly shorter than the radially outer header signal contact 324. Any difference in length may lead to skew problems, as the signals within the differential pair travel along different path lengths.

In an exemplary embodiment, at least some of the header signal contacts 324 may include compensation regions. For example, the radially outer header signal contacts 324 within each differential pair may include a compensation region. The compensation regions may have increased widths along segments of the conductors. The compensation regions may be at least partially exposed to air through the dielectric frame 302 to provide a different dielectric through which the conductor extends. For example, the dielectric frame 302 may include windows 344 (shown in phantom in FIG. 4) formed in the sides of the dielectric frame 302 that expose the conductors and or the compensation regions. In an exemplary embodiment, the windows 344 only expose the radially outer header signal contact 324 within each differential pair, such that the radially inner header signal contact 324 remains encased along the corresponding portion of the length thereof. Within each differential pair, the different dielectric (e.g. air for the radially outer header signal contact 324) allows the differential signal of the radially outer header signal contact 324 to travel at a different rate along the compensation region and window 344 as compared to the rate of travel of the differential signal of the radially inner header signal contact 324 through another dielectric (e.g. plastic). The number, size and shape of the compensation region may be selected to substantially reduce skew.

The ground shield 304 and the header ground contacts 322 are positioned with respect to the header signal contacts 324 to control electrical characteristics of the header signal contacts 324. For example, the size, shape and positioning of the ground shield 304 and/or header ground contacts 322 with respect to the header signal contacts 324 may control the impedance, cross talk, noise persistence and the like of the header signal contacts 324.

With reference to FIGS. 6 and 7, the contact module 134 is substantially similar to the contact module 132 (shown in FIG. 4), however the arrangement of ground and signal contacts differs from the contact module 132. In the illustrated embodiment, the header contacts 140 are arranged according to a signal-signal-ground pattern (S-S-G), from top to bottom, where the grounds are identified as header ground contacts 422 and the signals are identified as header signal contacts 424.

The contact module 134 includes a dielectric frame 402 holding a lead frame 400. The lead frame 400 comprises the header ground contacts 422 and the header signal contacts 424. A ground shield 404 is coupled to one side of the dielectric frame 402. The ground shield 404 provides electrical shielding for the header contacts 140 of the lead frame 400. The ground shield 404 may be selectively electrically coupled to the header ground contacts 422 in a similar manner as described above with respect to the ground shield 304 (shown in FIG. 4).

Figure 8:
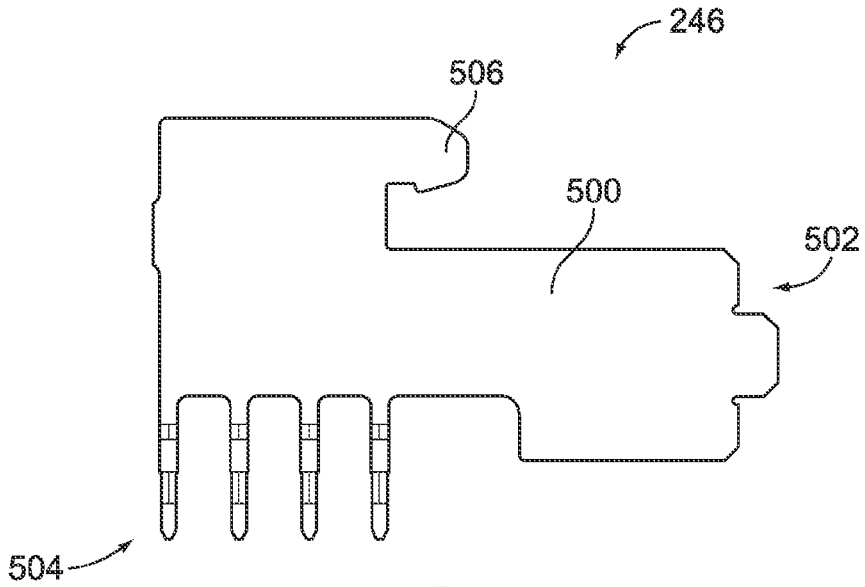
FIG. 8 is a side perspective view of a header power contact for the header connector.

FIG. 8 is a side perspective view of the receptacle power contact 246. The receptacle power contact 246 includes a planar body 500 having a mating portion 502 and a mounting portion 504. The mating portion 502 is arranged at a front of the body 500. The mounting portion 504 is arranged at a bottom of the body 500. The mating portion 502 defines a blade, however the mating portion may be another type of contact, such as a pin(s), socket, deflectable beam, and the like. The mounting portion 504 includes a plurality of compliant pins that are configured to be terminated to the first circuit board 108 (shown in FIGS. 1 and 2). Other types of interfaces may be provided at the mounting portion 504 for terminating to the circuit board 108.

The receptacle power contact 246 includes a mounting tab 506 extending therefrom. The mounting tab 506 is used to secure the receptacle power contact 246 in the receptacle housing 230 (shown in FIG. 3). Other types of mounting features may be used in alternative embodiments.

Figure 9:
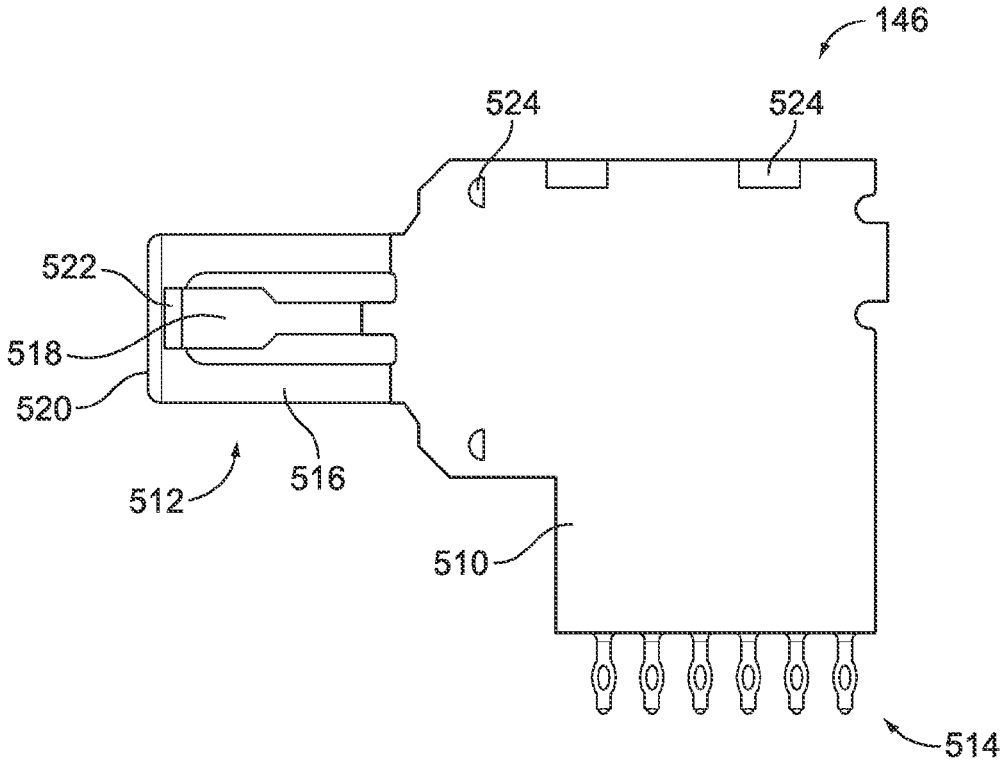
FIG. 9 is a side perspective view of a receptacle power contact for the receptacle connector.

FIG. 9 is a side perspective view of the header power contact 146. The header power contact 146 includes a planar body 510 having a mating portion 512 and a mounting portion 514. The mounting portion 514 is arranged at a bottom of the body 510. The mounting portion 514 includes a plurality of compliant pins that are configured to be terminated to the second circuit board 110 (shown in FIGS. 1 and 2). Other types of interfaces may be provided at the mounting portion 514 for terminating to the circuit board 110.

The mating portion 512 is arranged at a front of the body 510. The mating portion 512 includes a first beam 516 and a second beam 518 independently moveable with respect to one another. The first beam 516 is C-shaped and extends to a distal end 520. The second beam 518 is I-shaped and extends to a distal end 522. The distal ends 520, 522 are configured to engage opposite sides of the mating portion 502 (shown in FIG. 8) of the receptacle power contact 246. The distal ends 520, 522 are configured to be biased against the receptacle power contact 246 to ensure electrical contact between the header power contact 146 and the receptacle power contact 246. Other types of interfaces may be provided at the mating portion 512 for terminating to the receptacle power contact 246.

The header power contact 146 includes mounting tabs 524 extending therefrom. The mounting tabs 524 are bumps or protrusions that create an interference fit with the header housing 130 (shown in FIG. 3) to secure the header power contact 146 in the header housing 130. Other types of mounting features may be used in alternative embodiments.

Figure 10:
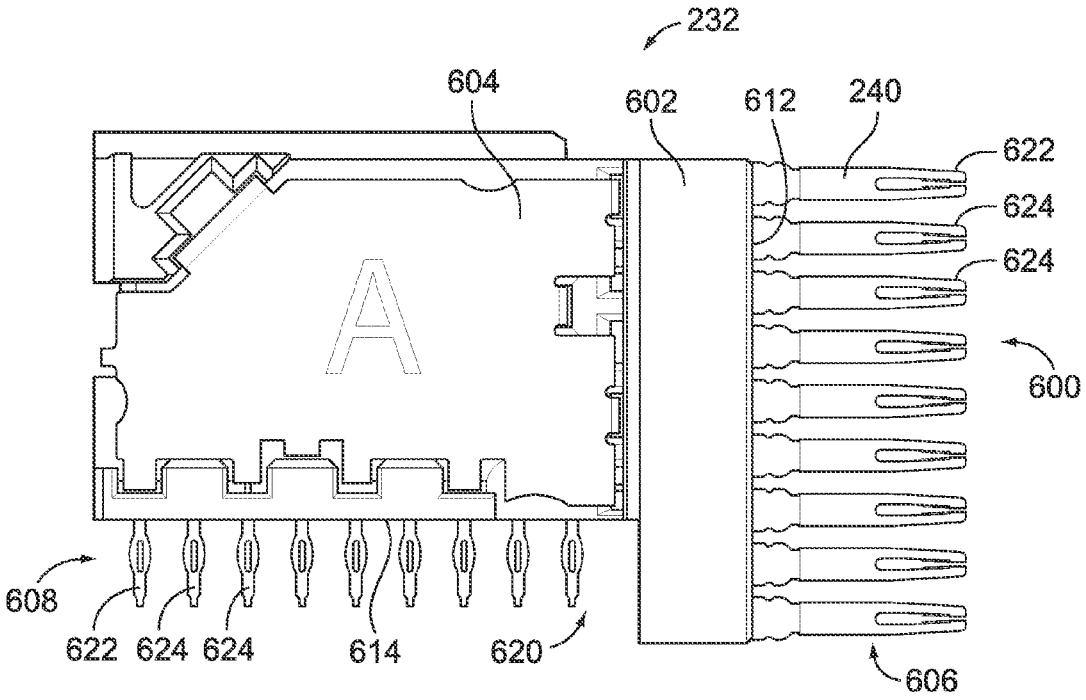
FIG. 10 is a side view of a receptacle contact module for the receptacle connector.
Figure 11:
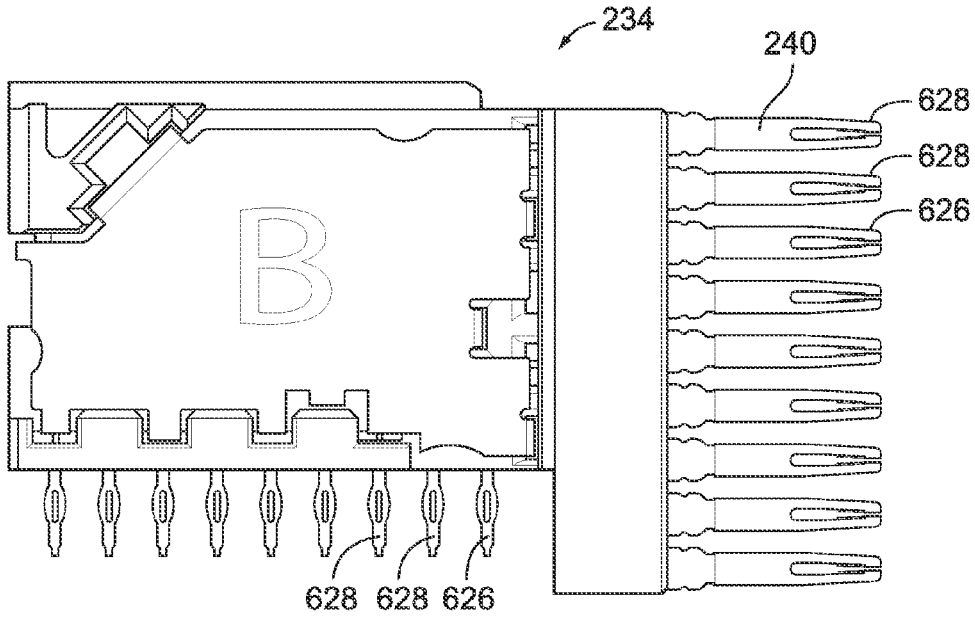
FIG. 11 is a side view of a receptacle contact module for the receptacle connector.

FIG. 10 is a side view of the receptacle contact module 232. FIG. 11 is a side view of the receptacle contact module 234. The receptacle contact module 234 is similar to the receptacle contact module 232, however the arrangement of ground and signal contacts differs from the contact module 232. Only the receptacle contact module 232 will be described in detail.

The contact module 232 includes a dielectric frame 602 holding a lead frame 600. The lead frame 600 comprises the receptacle contacts 240. A ground shield 604 is coupled to one side of the dielectric frame 602. The ground shield 604 provides electrical shielding for the receptacle contacts 240 of the lead frame 600. The ground shield 604 may be selectively electrically coupled to at least some of the receptacle contacts 240 in a similar manner as described above with respect to the ground shield 304 (shown in FIG. 4).

The receptacle contacts 240 have mating portions 606 extending from the dielectric frame 602 and mounting portions 608 extending from the dielectric frame 602. The receptacle contacts 240 have encased portions extending between the mating portions 606 and the mounting portions 608. The encased portions are the portions of the receptacle contacts 240 that are surrounded by the dielectric frame 602. In an exemplary embodiment, the receptacle contacts 240 are right angle contacts. The right angle contacts have the mating portions 606 and the mounting portions 608 orientated generally perpendicular with respect to one another. The mating portions 606 extend forward from a mating edge 612 of the dielectric frame 602. The mounting portions 608 extend from a mounting edge 614 of the dielectric frame 602. In the illustrated embodiment, the mating edge 612 defines a front edge of the dielectric frame 602 while the mounting edge 614 defines a bottom edge of the dielectric frame 602. The mounting edges 614 may define a bottom of the contact module, and may be referred to hereinafter as a bottom 614. The mating edge 612 and the mounting edge 614 are orientated generally perpendicular with respect to one another. The mating edge 612 and the mounting edge 614 generally meet at an intersection area 620, such as a corner, and extend radially out therefrom.

The dielectric frame 602 encases the receptacle contacts 240. In an exemplary embodiment, the dielectric frame 602 is manufactured using an over-molding process. During the molding process, the lead frame 600 is encased in a dielectric material, which forms the dielectric frame 602.

The receptacle contacts 240 may be either signal contacts or ground contacts in an exemplary embodiment. In other embodiments, the receptacle contacts 240 may be other types of contacts, such as power contacts, sense contacts or other types of contacts. In an exemplary embodiment, adjacent signal contacts may function as differential pairs, and each differential pair may be separated by a ground contact. In the illustrated embodiment, the receptacle contacts 240 of the contact module 232 are arranged according to a ground-signal-signal pattern (G-S-S), from top to bottom, where the grounds are identified as receptacle ground contacts 622 and the signals are identified as receptacle signal contacts 624. With reference to FIG. 11, in the illustrated embodiment, the receptacle contacts 240 of the contact module 234 are arranged according to a signal-signal-ground pattern (S-S-G), from top to bottom, where the grounds are identified as receptacle ground contacts 626 and the signals are identified as receptacle signal contacts 628.

In an exemplary embodiment, the receptacle ground contacts 622 may be similar to the header ground contacts 322 and include necked-down portions (not shown) configured to be engaged by the ground shield 604 when the ground shield 604 is coupled to the dielectric frame 602. In an exemplary embodiment, the receptacle ground contacts 622 have compensation portions (not shown) along segments thereof to control an electrical characteristic of the signals conveyed through the contact module 232. In an exemplary embodiment, at least some of the receptacle signal contacts 624 may include compensation regions exposed to air through the dielectric frame 602, such as by windows (not shown).

Figure 12:
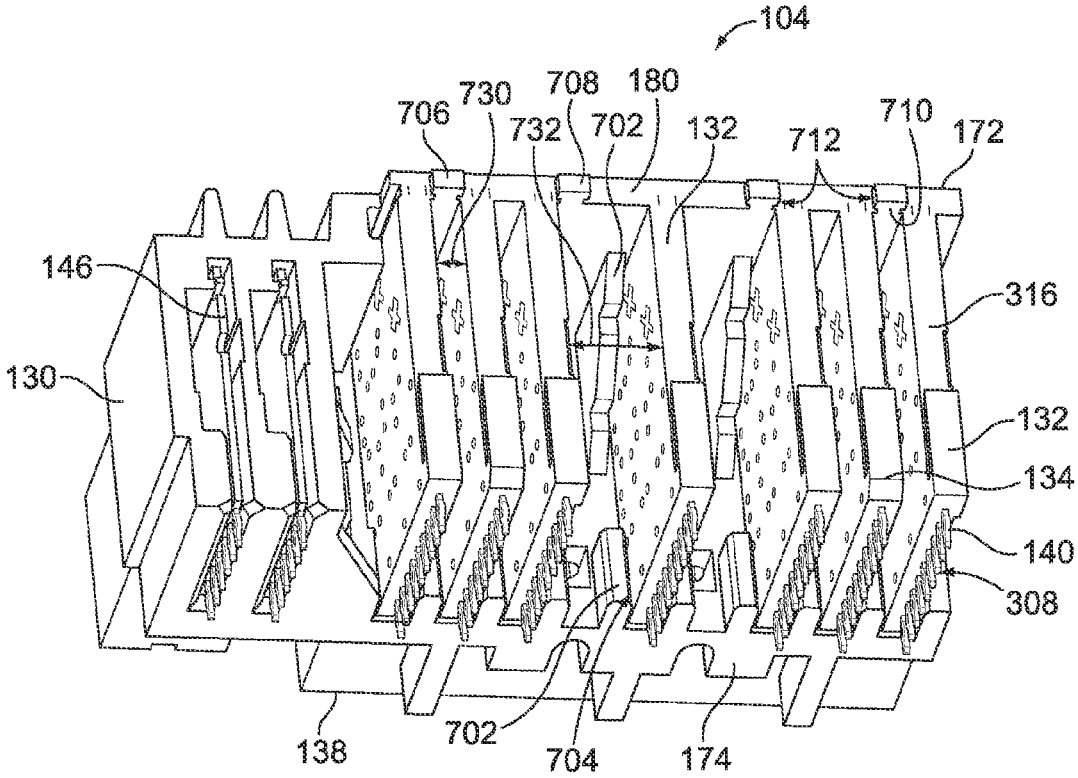
FIG. 12 is a rear perspective view of the header connector.
Figure 13:
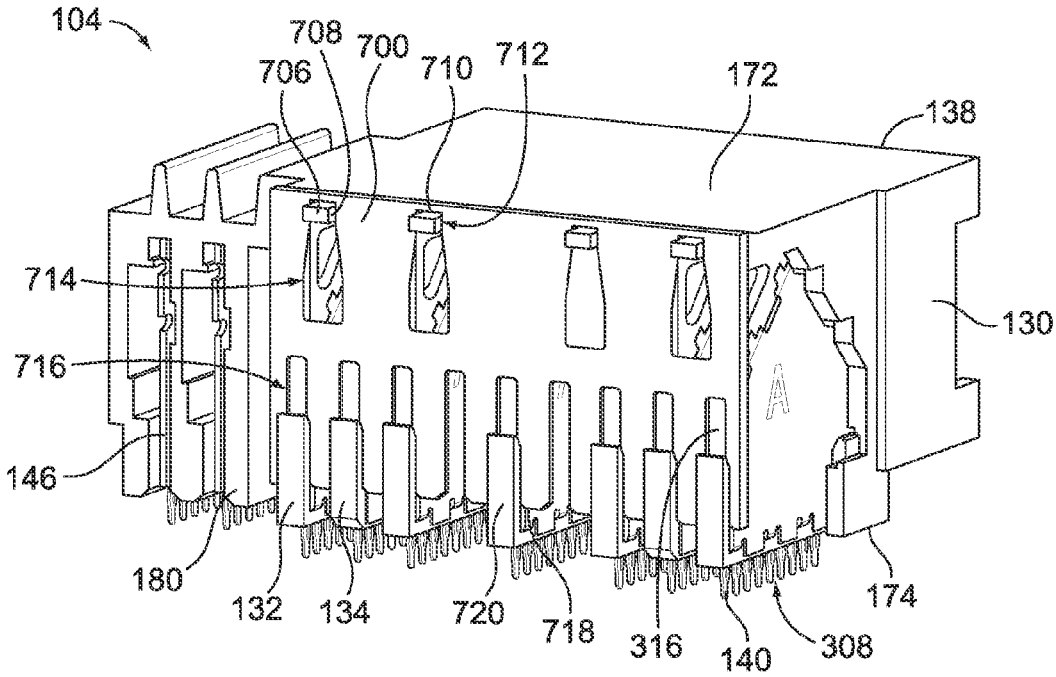
FIG. 13 is a rear perspective view of the header connector showing an organizer coupled to a header housing of the header connector.

FIG. 12 is a rear perspective view of the header connector 104. FIG. 13 is a rear perspective view of the header connector 104 showing an organizer 700 coupled to the header housing 130 and the header contact modules 132, 134.

The header contact modules 132, 134 are loaded into the header housing 130. The header power contacts 146 are loaded into the header housing 130. The header housing 130 includes ribs 702 forming channels 704 that receive the header contact modules 132, 134. The header contact modules 132, 134 are loaded into corresponding channels 704 through the rear 180. The header contact modules 132, 134 engage the ribs 702 to position the header contact modules 132, 134 with respect to the header housing 130. The ribs 702 may be provided along the top 172, the bottom 174 or other portions of the header housing 130.

In an exemplary embodiment, the top 172 extends further rearward than the bottom 174. Optionally, the ribs 702 may extend across a majority of the top 172 between the front 138 and the rear 180. The ribs 702 may provide strength or rigidity for the top 172.

The header housing 130 includes a plurality of mounting lugs 706 at the rear 180. In the illustrated embodiment, the mounting lugs 706 extend rearward from the rear 180 at the top 172. The mounting lugs 706 may be at other locations in alternative embodiments. Optionally, the mounting lugs 706 may have heads 708 at ends of stems 710. The heads 708 are wider than the stems 710. Gaps 712 are formed between the heads 708 and the header housing 130 along the stems 710. Alternatively, the mounting lugs 706 may have other shapes.

With reference to FIG. 13, the organizer 700 is a planar plate. The organizer 700 is coupled to the mounting lugs 706 by loading the organizer 700 onto the mounting lugs 706 in a vertically downward direction. The organizer 700 includes upper openings 714 that receive the mounting lugs 706. The organizer 700 is received in the gaps 712 and is captured between the header housing 130 and the heads 708. In the illustrated embodiment, the openings 714 are tapered such that, at the wider part of the openings 714, the heads 708 fit through the openings 714. The organizer 700 is lowered into position onto the mounting lugs 706 such that the narrower part of the openings 714 is aligned with the heads 708. The organizer 700 is then captured between the heads 708 and the header housing 130.

The organizer 700 includes lower openings 716 that are open at a bottom 718 of the organizer 700. The lower openings 716 are coupled to corresponding contact modules 132, 134. The lower openings 716 receive corresponding module lugs 720 on the rear edges 316 of the contact modules 132, 134. The module lugs 720 are aligned with the mounting lugs 706 to receive the planar organizer 700. The module lugs 720 are aligned with the mounting lugs 706 along an organizer plane that is parallel to the front 138 of the header housing 130. The organizer 700 is captured between the module lugs 720 and the rear edges 316. The organizer 700 holds the bottoms 314 of the contact modules 132, 134 in position with respect to one another and with respect to the header housing 130. The organizer 700 holds the true positions of the mounting portions 308 of the header contacts 140 for mounting to the circuit board 110 (shown in FIGS. 1 and 2). The organizer 700 controls the side-to-side position of the bottoms 314 of the contact modules 132, 134.

In an exemplary embodiment, the contact modules 132, 134 are held in the header housing 130 along parallel planes. The contact modules 132, 134 are positioned in corresponding channels 704. In an exemplary embodiment, the contact modules 132, 134 are stacked parallel to one another and spaced apart from one another. The contact modules 132, 134 have different pitches between some of the contact modules 132, 134. For example, some of the contact modules 132, 134 are spaced apart by a first pitch 730 and other contact modules 132, 134 are spaced apart by a second pitch 732. More than two pitches may be provided in other embodiments. The first pitch 730 may be approximately two times or three times the second pitch 732. Other pitches are possible in alternative embodiments. The different pitches allow the contact modules 132, 134 to be spaced apart different distances, such as to provide greater separation for one or more contact modules 132, 134 to reduce electrical interference (e.g. cross-talk, noise, etc) for such contact module(s) 132, 134. For example, one of the contact modules may be used as a high speed contact module having a higher throughput than other contact modules. Such contact module may be positioned further from the other contact modules to reduce interference for the high speed contact module. Optionally, the header housing 130 may have the channels 704 spaced equidistant and on the same pitch, but one or more channels 704 are left open and do not receive a contact module 132, 134 therein, creating a larger spacing between the contact modules received in the adjacent channels 704.

Figure 14:
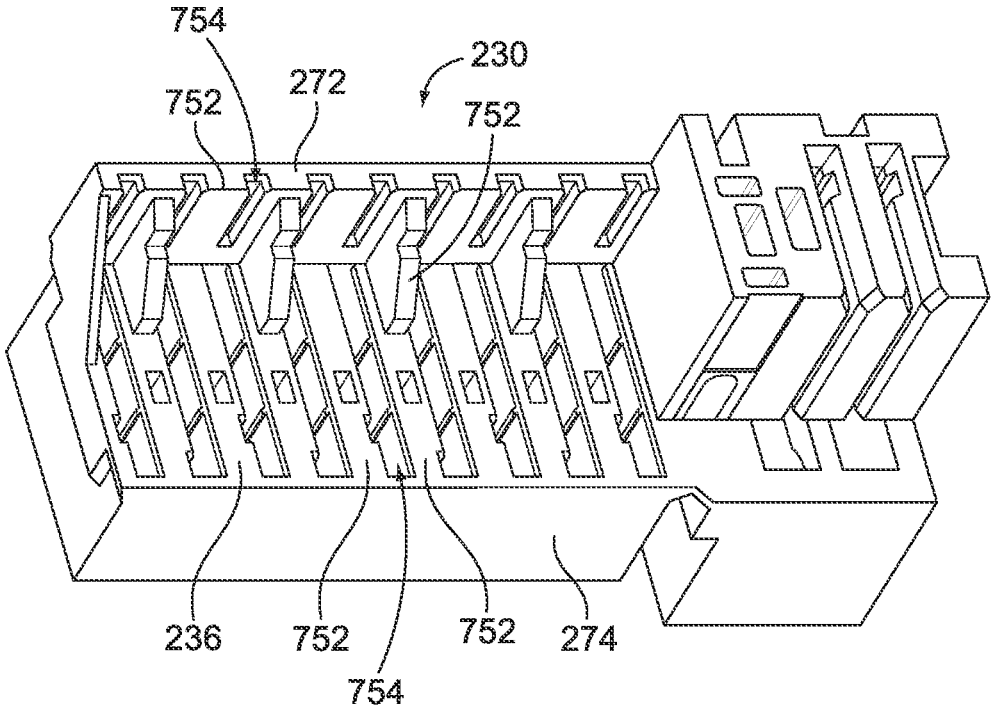
FIG. 14 is a rear perspective view of a receptacle housing for the receptacle connector.

FIG. 14 is a rear perspective view of the receptacle housing 230. The receptacle housing 230 is used to hold the receptacle contact modules 232, 234 (shown in FIGS. 10 and 11) and the receptacle power contacts 246 (shown in FIG. 8). The receptacle housing 230 includes ribs 752 forming channels 754 that receive the receptacle contact modules 232, 234. The channels 754 may have keying features to ensure that the correct receptacle contact modules 232, 234 are loaded therein and/or the receptacle contact modules 232, 234 are loaded in the proper orientation. The receptacle contact modules 232, 234 are loaded into corresponding channels 754 through the rear 236. The receptacle contact modules 232, 234 engage the ribs 752 to position the receptacle contact modules 232, 234 with respect to the receptacle housing 230. The ribs 752 may be provided along the top 272, the bottom 274 or other portions of the receptacle housing 230.

In an exemplary embodiment, the top 272 extends further rearward than the bottom 274. Optionally, the ribs 752 may extend across a majority of the top 272 between the front 238 and the rear 236. The ribs 752 may provide strength or rigidity for the top 272.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector system comprising:

a right angle header connector having a header housing and a plurality of header contact modules coupled to the header housing, the header housing having a cavity open at a front of the header housing, the header contact modules having a plurality of header contacts extending between mating portions and mounting portions, the header contacts being right angle contacts having the mating portions oriented generally perpendicular with respect to the mounting portions, the mating portions being positioned in the cavity and defining separable mating interfaces, the mounting portions extending from bottoms of the header contact modules for mounting to a circuit board; and a right angle receptacle connector having a receptacle housing and a plurality of receptacle contact modules coupled to the receptacle housing, the receptacle housing being received in the cavity of the header housing through the front of the header housing, the receptacle contact modules having a plurality of receptacle contacts extending between mating portions and mounting portions, the receptacle contacts being right angle contacts having the mating portions oriented generally perpendicular with respect to the mounting portions, the mating portions of the receptacle contacts being mated to the mating portions of the header contacts, the mounting portions of the receptacle contacts extending from bottoms of the receptacle contact modules for mounting to a circuit board;

wherein the bottoms of the receptacle contact modules are parallel to and non-coplanar with respect to the bottoms of the header contact modules.

2. The connector system of claim 1, wherein the header housing has a wall defining a bottom thereof, the receptacle housing has a wall defining a bottom thereof, the bottoms of the header contact modules being positioned below the bottom of the header housing, the bottoms of the receptacle contact modules being positioned above the bottom of the receptacle housing.

3. The connector system of claim 1, wherein the bottoms of the header contact modules extend across a first plane and the bottoms of the receptacle contact modules extend across a second plane parallel to and offset with respect to the first plane.

4. The connector system of claim 1, wherein the header housing defines a housing window, the bottoms of the header contact modules being outside the housing window, the bottoms of the receptacle contact modules being inside the window.

5. The connector system of claim 1, wherein the header contact modules are stacked parallel to one another and spaced apart from one another, the header contact modules having different pitches between at least some of the header contact modules.

6. The connector system of claim 1, wherein the header contact modules include at a first header contact module, a second header contact module and a third header contact module, the first and second header contact modules being spaced apart by a first pitch, the second and third header contact modules being spaced apart by a second pitch different than the first pitch.

7. The connector system of claim 1, wherein each header contact module comprises a dielectric frame holding the header contacts, the header contacts include header signal contacts and header ground contacts, the header signal contacts being arranged in pairs carrying differential signals with at least one header ground contact between each pair of header signal contacts.

8. The connector system of claim 7, wherein the dielectric frame has windows exposing to air segments of the header signal contacts to control an electrical characteristic of the header signal contacts.

9. The connector system of claim 7, wherein the header ground contacts have compensation portions along segments thereof to control an electrical characteristic of the header signal contacts.

10. The connector system of claim 9, wherein the compensation portions are wider than the adjacent segments of the header ground contacts to position the header ground contacts closer to the header signal contacts along the compensation portions.

11. The connector system of claim 7, wherein each header contact module comprises a ground shield coupled to a side of the dielectric frame, the ground shield having tabs extending through the dielectric frame to engage the header ground contacts.

12. A connector system comprising:

a right angle header connector comprising:

a header housing having a cavity open at a front of the header housing, the cavity configured to receive a receptacle connector therein, the header housing having walls defining a top, bottom and sides, the top extending to a rear of the header housing, the rear having mounting lugs extending therefrom, the header housing having a plurality of channels accessible at the rear;

header contact modules loaded into corresponding channels through the rear, the header contact modules each having a dielectric frame holding a plurality of header contacts, the header contacts have mating portions extending from a front edge of the dielectric frame and mounting portions extending from a bottom edge of the dielectric frame, the header contacts being right angle contacts having the mating portions oriented generally perpendicular with respect to the mounting portions, the mating portions being positioned in the cavity and defining separable mating interfaces, the mounting portions being configured to be mounted to a circuit board, the dielectric frame includes at least one module lug extending from a rear of the dielectric frame; and an organizer coupled to the mounting lugs and the module lugs rearward of the header housing and rearward of the header contact modules, the organizer holding a position of the header contact modules with respect to the header housing.

13. The connector system of claim 12, wherein the organizer comprises a planar plate having upper openings receiving the mounting lugs and lower openings receiving the module lugs.

14. The connector system of claim 12, wherein the top includes ribs extending across a majority of the top to define the channels, the ribs engaging the header contact modules to locate the header contact modules with respect to the header housing.

15. The connector system of claim 12, wherein the mounting lugs and the module lugs are aligned along an organizer plane parallel to the front of the header housing.

* * * * *